US006640996B2

(12) United States Patent
Jones et al.

(10) Patent No.: US 6,640,996 B2
(45) Date of Patent: Nov. 4, 2003

(54) METHOD AND APPARATUS FOR ONLINE SWITCHING BETWEEN SUPPLY VESSELS

(75) Inventors: Angela H. R. Jones, Rochester, NY (US); Steven D. Possanza, Penfield, NY (US); Brian J. Connolly, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 111 days.

(21) Appl. No.: 10/027,301

(22) Filed: Dec. 21, 2001

(65) Prior Publication Data

US 2003/0116585 A1 Jun. 26, 2003

(51) Int. Cl.[7] ..... B67D 5/06

(52) U.S. Cl. ..... 222/1; 222/66; 222/144.5; 222/148; 137/487.5

(58) Field of Search ..... 222/1, 52, 64, 222/66, 129, 144.5, 145.1, 145.2, 148; 137/2, 467.5, 487.5

(56) References Cited

U.S. PATENT DOCUMENTS 3,810,778 A * 5/1974 Wang ..... 430/495.1
4,247,018 A * 1/1981 Credle ..... 222/1
4,467,941 A * 8/1984 Du ..... 222/1
5,009,339 A * 4/1991 Hanerus et al. ..... 222/1
5,154,314 A * 10/1992 Van Wormer ..... 222/1
5,156,298 A 10/1992 LaRue
5,433,344 A * 7/1995 Fulton et al. ..... 222/65
6,037,010 A * 3/2000 Kahmann et al. ..... 427/421

* cited by examiner

*Primary Examiner*—Gene Mancene
*Assistant Examiner*—Patrick Buechner
(74) *Attorney, Agent, or Firm*—Mark G. Bocchetti

(57) ABSTRACT

A method and apparatus for switching a supply to a process from a first vessel to a second vessel. Liquid is flowed from the first vessel through a first outlet conduit through a vessel selection valve, including first and second switch valves, to the process. A conductivity sensor measures the conductivity level of the liquid in the first outlet conduit at a point upstream of the selection valve and a computer compares the conductivity level to a predetermined range. The computer signals an isolation valve, in a second outlet conduit from the second vessel, to open and allow liquid to displace air in the second outlet conduit from the second vessel to the selection valve. The computer determines a delay to allow liquid below the first conductivity sensor to reach the first switch valve, then closes the first switch valve and opens the second switch valve.

10 Claims, 1 Drawing Sheet

METHOD AND APPARATUS FOR ONLINE SWITCHING BETWEEN SUPPLY VESSELS

FIELD OF THE INVENTION

The present invention relates generally to valve switching manifolds and, more particularly, to methods and apparatus for online switching between supply vessels for continuous operations.

BACKGROUND OF THE INVENTION

Modern methods to continuously manufacture complex photographic products require a constant source of coating solution. These photographic products typically involve the uniform coating of photosensitive compositions on a substrate, such as, for example, a continuous web of paper, cellulose acetate, polyethylene terephthalate, or PEN. Traditionally, a particular coating solution is prepared in one vessel, and coating is performed using that one vessel as the source for that particular coating solution. Coating of that solution from that source continues until the vessel is nearly empty. At that point, the supply to the coating operation is switched to a second vessel, such that the second vessel containing the same coating solution becomes the source for that coating solution. The remaining coating solution in the old or first vessel and the piping associated therewith becomes waste.

In the past, switching between source vessels has been performed using level sensors to sense when the level of coating solution in the vessel is approaching depletion. When using such a method to determine when to switch from one supply vessel to another in a coating operation, there is considerable waste of usable material in the vessel being superseded. Some of the materials used in making photographic coating compositions are very costly and such waste of usable material can represents a great expense.

In current practice, switching may be performed in accordance with method and apparatus disclosed in U.S. Pat. No. 5,156,298 issued Oct. 20, 1992 to LaRue, the relevant disclosure of which is incorporated herein by reference. LaRue provides a change or switching valve at a juncture between the conduits leading from the first and second containers, and further includes a commercially-available conductivity sensor in each of the conduits between the containers and the change valve. A third conduit from the switching valve leads to a coating hopper. The two conductivity sensors are connected by electric leads to a computer. Stored within the computer is a range of values which represents values of the conductivity of composition when it is acceptable for coating. It will be recognized that the conductivity of composition froth is different from the conductivity of composition free of air bubbles, or of air itself, so that it is possible to use conductivity as a metric for determining acceptability or unacceptability of composition for coating. Thus, when the conductivity detected by the sensor goes outside of the range of acceptable values, it can be taken that the composition passing through the sensor is no longer usable for coating. At such time, the computer sends a signal to the switching valve to close off flow from the first vessel and to simultaneously open flow from the second vessel.

It will be recognized that the volume of usable composition, which is wasted each time the switching valve switches from taking supply from one container to taking supply from the other container, is approximately the volume of the length of conduit between the sensor and the switching valve. In some prior art composition delivery systems however, this may still amount to up to several liters of wasted good composition.

Further in the prior art, typically the conduit leading from the second vessel to the switching valve is prepared for introduction of composition from the second container by being back-filled with water from a port in the switching valve to a port in the container valve to purge air from the conduit. Then, and again prior to the actual switching, the container valve is opened and composition is allowed to flow downwards through the conduit, displacing the backfill water through a drain port in the switching valve. Because the composition typically is water-miscible and generally has a specific gravity that is greater than water, there can be considerable mixing of the composition with the backfill water during this downwards purging of water by composition. Thus, an excess of good composition must be diverted to the drain in order to be sure that all the backfill water has been displaced. Otherwise, the first composition sent to the hopper from the second container after switching over will be diluted, resulting in coating defects. Again, several liters of usable material from the second container may be wasted.

SUMMARY OF THE INVENTION

It is therefore an object of the present invention to minimize the waste volume of usable coating composition resulting from an online changeover from a first vessel depleted of coating composition to a second vessel containing a fresh supply of coating composition.

It is a further object of the present invention to provide for automatic changeover from a depleted to source vessel to a fresh source vessel.

Another object of the invention is to provide such a changeover without introducing air bubbles into the conduit leading from the switching valve to the coating apparatus.

Yet another object of the present invention is to provide such a changeover between vessels wherein the amount of usable composition wasted by the changeover is substantially zero.

Briefly stated, the foregoing and numerous other features, objects and advantages of the present invention will become readily apparent upon a review of the detailed description, claims and drawings set forth herein. These features, objects and advantages are accomplished by connecting each of two source vessels to a vessel-switching valve via respective outlet conduits. The vessel-switching valve has a single delivery conduit for delivering coating solution to a coating apparatus. There is a conductivity sensor located in each vessel outlet conduit between a respective vessel isolation valve and the vessel-switching valve. The conductivity sensors are used to determine whether the contents of the outlet conduits are suitable for delivery to the coating apparatus. An acceptable range of conductivity for the composition type is predetermined. At a predetermined time during delivery of the composition from the first vessel to the switching valve, the vessel isolation valve of the second vessel is opened. The then empty outlet conduit from the second vessel is allowed to fill by gravity to the switching valve thereby displacing the air in the outlet conduit upwards by buoyancy through the coating composition in the second vessel. The volume of that portion of the conduit from the vessel first between the conductivity sensor and the switching valve as well as the volumetric flow rate of the liquid composition is provided to a computer or programmable logic controller. Using this information, the computer can calculate the period of time that it will take to exhaust the volume of coating solution in that portion of the outlet conduit. When the sensor in the outlet conduit from the first vessel indicates a conductivity that is outside the predetermined range, the computer begins a timing operation based on the calculated period of time. At the expiration of that period of time substantially the last of the usable coating composition has reached the switch valve. The computer then opens the switch valve controlling flow from the second vessel thereby allowing coating composition to begin flowing from the second vessel. Shortly thereafter, the valve controlling flow from the first vessel is closed thereby shutting off further flow from the outlet conduit from the first vessel and also preventing coating composition from the outlet conduit of the second vessel from backing up into the outlet conduit from the first vessel. Flow is thus changed over from the first vessel to the second vessel. This is accomplished without introduction of any air into the outlet conduit of the second vessel and with substantially no usable coating composition remaining in the outlet conduit from the first vessel. Further, no waste of usable coating composition has been generated in preparing the outlet conduit from the second vessel for delivery of composition to the vessel-switching valve.

This method allows vessels (kettles or any other continuous source of supply) to be switched online with zero liquid waste and without the introduction of bubbles or flow perturbations to coating. A single bubble, 30 microns or larger can cause a coated defect. Flow perturbations as low as ±2.0% of aim flow rate can also cause coated waste.

BRIEF DESCRIPTION OF THE DRAWINGS

The FIGURE is a process flow schematic depicting a system for switching from a first source vessel to a second source vessel, each containing a liquid composition to be supplied to a downstream process.

DETAILED DESCRIPTION OF THE INVENTION

Figure 1:
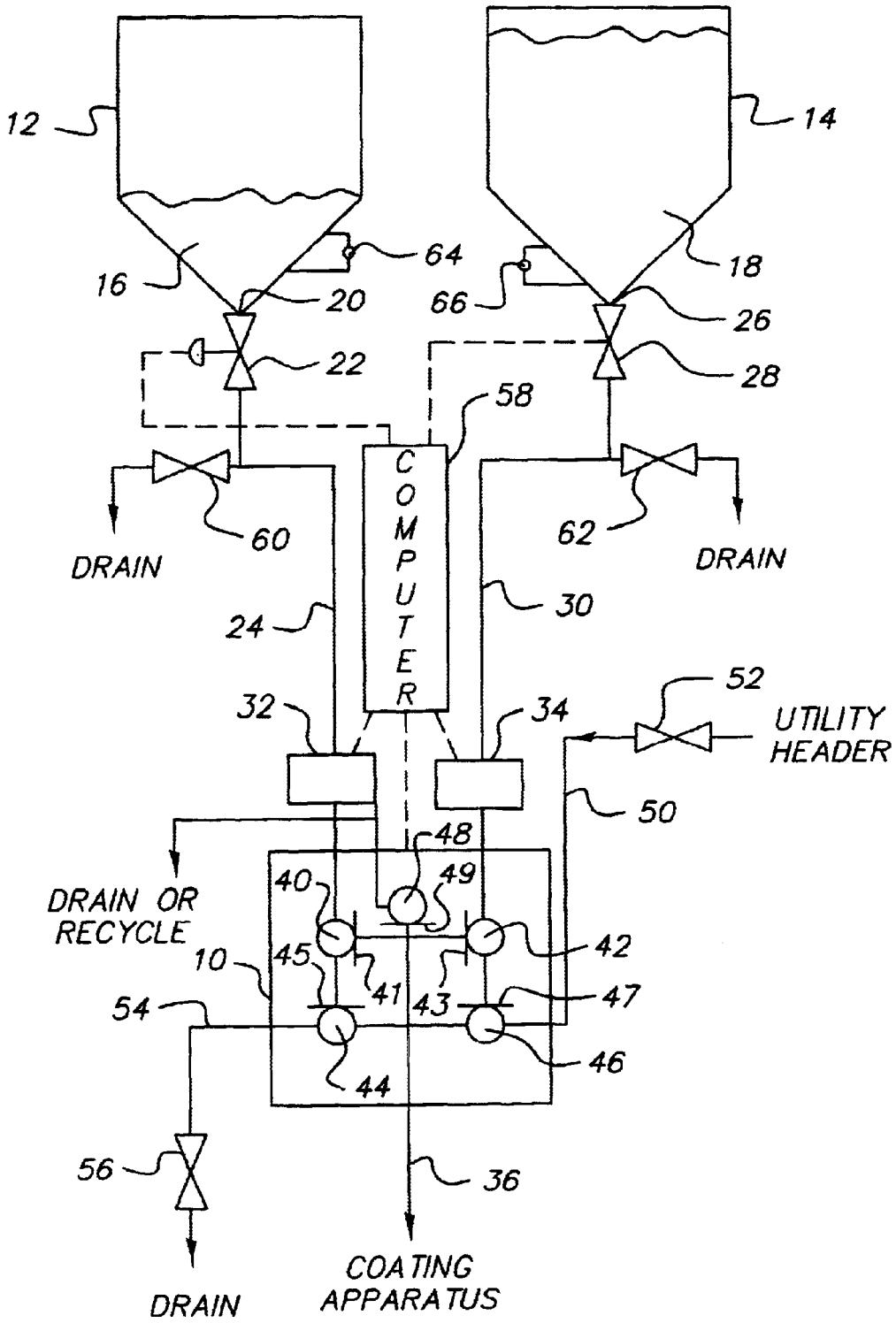

Referring to the FIGURE, a vessel selection valve 10 is schematically depicted in combination with a first supply vessel 12 and a second supply vessel 14. First supply vessel 12 and second supply vessel 14 contain liquid such as, for example, liquid coating solution to be applied to a moving web in a downstream coating operation for the manufacture of photographic films and papers. First supply vessel 12 contains a first quantity 16 of a particular coating composition and second supply vessel 14 contains a second quantity 18 of the same coating composition. Vessel selection valve 10 allows for switching between flow of the liquid composition from the first supply vessel 12 and flow of the liquid composition from the second supply vessel 14. First supply vessel 12 has an outlet 20 with an isolation valve 22 attached thereto. There is an outlet conduit 24 connecting isolation valve 22 to vessel selection valve 10. Similarly, second supply vessel 14 has an outlet 26 with an isolation valve 28 attached thereto. There is an outlet conduit 30 connecting isolation valve 28 to vessel selection valve 10. There is a first conductivity sensor 32 in outlet conduit 24 and a second conductivity sensor 34 in outlet conduit 30. There is a delivery conduit 36 exiting vessel selection valve 10 that delivers liquid solution to the downstream process which includes a coating apparatus. The remainder of a composition delivery system downstream (not shown) of the vessel selection valve 10 may be, for example, substantially as disclosed in U.S. Pat. No. 5,156,298 which is hereby incorporated herein by reference.

Conduit 24 connects to valve 40 in vessel selection valve 10 and conduit 30 connects to valve 42 in vessel selection valve 10. When valve 40 is open, liquid flows through valve 40 from conduit 24 and into delivery conduit 36. Similarly, when valve 42 is open, liquid flows through valve 42 from conduit 30 and into delivery conduit 36. Thus, switching between valves 40, 42 allows selection of either vessel 12, 14 as the source for supplying liquid to the downstream operation.

Vessel selection valve 10 further includes flush/drain valves 44, 46 associated with switch valves 40, 42, respectively, and with a flush/purge valve 48. A utility supply pipe 50 for supplying flush water, for example, and having a control valve 52 therein, is in fluid communication with flush/drain valves 44, 46. A drain line 54 having a valve 56 therein is connected to flush/drain valve 44. Flush/purge valve 48 connects to switch valves 40, 42 to permit reverse flushing and air purging with water through delivery conduit 36.

The two conductivity sensors 32, 34 are preferably identical and may be, for example, as described and illustrated in the incorporated reference. Each sensor 32, 34 is intended for use in determining the conductivity of the fluent composition flowing through it. A suitable sensor is offered as Model No. 871 AB-3 by Foxboro Instrument Corp, Foxboro, Mass., USA. The two sensors 32, 34 are connected to the process control computer or programmable logic controller (PLC) 58 which is programmed to monitor the signals therefrom, representing the conductivity levels of material within the sensors 32, 34 at any given time. Computer 58 is further connected to vessel selection valve 10. Vessel selection valve 10 is controlled by computer or programmable logic controller (PLC) 58. Each valve 40, 42, 44, 46, 48 in vessel selection valve 10 is independently controllable by computer 58 to open and close a respective flow path gate 41, 43, 45, 47, 49. Computer 58 also controls isolation valves 22, 28.

In operation, as the last of the usable composition 16 from first vessel 12 (defined by a previously specified conductivity) passes beyond sensor 32, an unacceptable change in composition conductivity is sensed by sensor 32. The signal from sensor 32 is monitored by computer 58. Computer 58 is also provided with input representing the flow rate of composition through conduit 24. Using the volume of conduit 24 between sensor 32 and switch valve 40, computer 58 calculates the time required for the last of the usable composition to reach switch valve 40. Computer 58 then executes a timing function to delay changing over flow from switch valve 40 to switch valve 42 until, preferably, the precise moment at which the last of the usable composition reaches switch valve 40. In changing over, preferably the switch valve 42 controlling flow from the second vessel 14 is opened momentarily before the switch valve 40 controlling flow from the expiring first vessel 12 is closed, to ensure that there is no momentary loss of flow through delivery conduit 36. Of course, in practice it may be desirable to make the changeover slightly sooner than the calculated time to ensure that no unusable composition enters delivery conduit 36. Thus, the changeover would typically be made less than about 5 seconds (depending on flow rate) prior to the expiration of the calculated period of time required for the last of the usable composition to reach switch valve 40. The actual period of delay can, therefore, be something slightly less than the actual calculated period of time.

When first vessel 12 is cleaned and recharged with another batch of composition 16, the liquid composition 18 in second vessel 14 is being consumed. Thus, when the composition within vessel 14 is about to be exhausted the changeover process is repeated understanding that the depleted vessel 14 is now the first vessel and recharged vessel 12 is the second vessel.

After flow has been changed over from vessel 12 to vessel 14, any remaining unusable composition in vessel 12 may be drawn off for further use or recycling via valves 22, 60. Similarly, after flow has been changed over from vessel 14 to vessel 12, any remaining unusable composition in vessel 14 may be drawn off for further use or recycling via valves 28, 62. Also, conduit 24 may be flush cleaned, as is customary between batches, even of the same formula composition, by opening valve 52, flush/drain valve 44, and valve 60. Conduit 24 may subsequently be drained by closing valve 52 and opening drain valve 56.

Preferably, vessel selection valve 10 is mounted at an elevation below vessels 12, 14 such that all runs of conduits 24, 30 have no reverse-direction bends and, therefore, no bubble traps. Following flush cleaning as described above, a conduit 24, 30 may be drained of flush water by opening the appropriate valve 60, 62, the appropriate flush/drain valve 44, 46, and drain valve 56. As a conduit drains, it fills with air. The just-mentioned valves are then closed, and the appropriate vessel isolation valve 22, 28 for the fresh vessel 12, 14 is opened, preferably at a signal from computer 58 which is timed to occur near the expiration of the then-flowing batch from the other vessel 12, 14. In the manufacture of photographic products, it is considered good practice to fill the new conduit only a short time prior to changeover. When a particular isolation valve 22, 28 is opened, the air in the respective conduit 24, 30 is displaced by fresh composition, the displaced air bubbling up through the isolation valve 22, 28 and being expelled through the vessel 12, 14 to atmosphere. Fresh, bubble-free composition is then in place in the chamber of the appropriate switch valve 40, 42, ready for changeover, and no usable composition is wasted to the drain.

Each vessel 12, 14 includes a respective level sensor 64, 66. The respective outlet conduit 24, 30 is prepared in advance of the expiration of the opposite outlet conduit 24, 30 such that line preparation is not a factor in vessel switching. Because vessel-level sensors 64, 66 are not used in the process, except to determine when to prepare the new outlet conduit 24, 30, errors in such sensors in the range of ±5–10% errors are not significant.

The embodiment of the invention, as described herein, comprises apparatus and method for changing between two alternating vessels. However, those skilled in the art will recognize that an arrangement involving three of more containers can benefit from the invention. The only requirements for using the present invention with three or more vessels are that each vessel be provided with an independent outlet conduit, conductivity sensor, and switch valve in the vessel selection valve.

The method of the present invention not only fully utilizes vessel contents, but also fully utilizes line contents from each vessel 12, 14 to the vessel selection valve 10. There are no flow perturbations associated with the method. No air is introduced into the downstream process, which would subsequently have to be removed.

Vessel selection valve 10 is schematically depicted as a single multiport valve. While a single multiport valve is preferred, those skilled in the art will recognize that vessel selection valve 10 can comprise a plurality of interconnected individual two and three way valves, or a combination of multiport valve(s) and two and three way valves.

From the foregoing, it will be seen that this invention is one well adapted to obtain all of the ends and objects hereinabove set forth together with other advantages which are apparent and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth and shown in the accompanying drawings is to be interpreted as illustrative and not in a limiting sense.

PARTS LIST

10 vessel selection valve
12 first supply vessel
14 second supply vessel
16 first quantity
18 second quantity
20 outlet
22 isolation valve
24 outlet conduit
26 outlet
28 isolation valve
30 outlet conduit
32 first conductivity sensor
34 second conductivity sensor
36 delivery conduit
40 Valve
41 flow path gate
42 valve
43 flow path gate
44 flush/drain valves
45 flow path gate
46 flush/drain valves
47 flow path gate
48 flush/purge valve
49 flow path gate
50 utility supply pipe
52 control valve
54 drain line
56 valve
58 process control computer or programmable logic controller
60 valve
62 valve
64 respective level sensor
66 respective level sensor

What is claimed is:

1. An apparatus for continuously supplying a liquid composition to a downstream process, comprising:

(a) a first vessel containing a first batch of the liquid composition and having a first vessel isolation valve;

(b) a second vessel containing a second batch of the liquid composition and having a second vessel isolation valve;

(c) a vessel selection valve including a first switch valve and a second switch valve;

(d) a first outlet conduit from the first vessel isolation valve to the first switch valve;

(e) a second outlet conduit from the second vessel isolation valve to the second switch valve;

(f) a first conductivity sensor located in the first outlet conduit at a first known distance from the first switch valve for measuring electrical conductivity of the composition in the first outlet conduit;

(g) a second conductivity sensor located in the second outlet conduit at a second known distance from the second switch valve for measuring electrical conductivity of the composition in the second outlet conduit;

(h) a delivery conduit connected to the vessel selection valve for transmitting fluid therethrough downstream of the vessel selection valve;

(i) a process control computer receiving input from the first and second conductivity sensors and controlling actuation of the first and second switch valves in response thereto, the computer opening the second switch valve and closing the first switch valve when the conductivity in the first outlet conduit is outside a predetermined range, the computer delaying closing the first switch valve for a period time to allow for liquid in the first outlet conduit below the first conductivity sensor to reach the first switch valve before closing the first switch valve.

2. An apparatus for switching supply from a first vessel containing a first batch of a liquid composition to a second vessel containing a second batch of the liquid composition, both supplying the liquid composition to a downstream process, comprising:

(a) a first vessel isolation valve;

(b) a second vessel isolation valve;

(c) a vessel selection valve including a first switch valve and a second switch valve;

(d) a first outlet conduit from the first vessel isolation valve to the first switch valve;

(e) a second outlet conduit from the second vessel isolation valve to the second switch valve;

(f) a first conductivity sensor located in the first outlet conduit at a first known distance from the first switch valve for measuring electrical conductivity of the composition in the first outlet conduit;

(g) a second conductivity sensor located in the second outlet conduit at a second known distance from the second switch valve for measuring electrical conductivity of the composition in the second outlet conduit;

(h) a delivery conduit connected to the vessel selection valve for transmitting fluid therethrough downstream of the vessel selection valve;

(i) a process control computer receiving input from the first and second conductivity sensors and controlling actuation of the first and second switch valves in response thereto, the computer opening the second switch valve and closing the first switch valve when the conductivity of the liquid in the first outlet conduit is outside a predetermined range, the computer determining a period of delay for closing the first switch valve that will allow the liquid in the first outlet conduit below the first conductivity sensor to reach the first switch valve before closing the first switch valve.

3. An apparatus as recited in claim 2, the vessel selection valve further comprising:

(a) a first flush/drain valve associated with the first switch valve;

(b) a second flush/drain valve associated with the second switch valve; and (c) a flush/drain connected to the vessel selection valve and communicating with both the first flush/drain valve and the second flush/drain valve.

4. An apparatus as recited in claim 3 the vessel selection valve further comprising:

a flush/purge valve in the delivery conduit upstream of the first and second switch valves allowing reverse flow flushing and purging of the delivery conduit through the vessel selection valve.

5. An apparatus as recited in claim 3 wherein:

the vessel selection valve is a single multiport valve assembly.

6. An apparatus as recited in claim 3 wherein:

the vessel selection valve is a combination of interconnected valves and multiport valves.

7. A method for switching supply from a first vessel containing a first batch of a liquid composition to a second vessel containing a second batch of the liquid composition, both supplying the liquid composition to a downstream process, comprising the steps of:

(a) flowing the liquid composition from the first vessel through a first outlet conduit from the first vessel and through a vessel selection valve to a downstream process, the vessel selection valve including a first switch valve and a second switch valve;

(b) sensing a conductivity level of the liquid composition at a point in the outlet conduit from the first vessel before the vessel selection valve, the computer means comparing the conductivity level to a predetermined range;

(c) the computer signaling a vessel isolation valve in a second outlet conduit from the second vessel to open, thereby displacing air in the second outlet conduit and filling the second outlet conduit with the liquid composition from the second vessel to the vessel selection valve;

(d) the computer determining a first period of delay for closing the first switch valve that will allow the liquid in the first outlet conduit below the first conductivity sensor to reach the first switch valve before closing the first switch valve;

(e) the computer closing the first switch valve and opening the second switch valve after a first time period that is not greater than the first period of delay; and (f) flowing the liquid composition from the second vessel through the second outlet conduit and through the vessel selection valve to the downstream process.

8. A method as recited in claim 7 wherein:

the second switch valve opened before the first switch valve is closed.

9. A method as recited in claim 8 further comprising the steps of:

purging and draining the first outlet conduit through the vessel selection valve after the first switch valve has been closed.

10. A method as recited in claim 9 further comprising the steps:

(a) placing a new batch of the liquid composition in the first vessel;

(b) sensing a conductivity level of the liquid composition at a point in the second outlet conduit from the second vessel prior to the vessel selection valve, the computer means comparing the conductivity level to the predetermined range;

(c) the computer signaling a vessel isolation valve in the first outlet conduit to open, thereby displacing air in the first outlet conduit and filling the first outlet conduit with the liquid composition from the first vessel to the vessel selection valve;

(d) the computer determining a second period of delay for closing the first switch valve that will allow the liquid in the second outlet conduit below the second conductivity sensor to reach the second switch valve before closing the second switch valve;

(e) the computer closing the second switch valve and opening the first switch valve after a second time period that is not greater than the second period of delay; and (f) flowing the liquid composition from the first vessel through the first outlet conduit and through the vessel selection valve to the downstream process.

* * * * *